US011786964B2

(12) United States Patent
Ishii

(10) Patent No.: US 11,786,964 B2
(45) Date of Patent: Oct. 17, 2023

(54) METHOD FOR PRODUCING CU—NI—SN ALLOY

(71) Applicant: NGK INSULATORS, LTD., Nagoya (JP)

(72) Inventor: Kensuke Ishii, Farragut, TN (US)

(73) Assignee: NGK INSULATORS, LTD., Nagoya (JP)

( * ) Notice: Subject to any disclaimer, the term of this patent is extended or adjusted under 35 U.S.C. 154(b) by 0 days.

(21) Appl. No.: 17/652,164

(22) Filed: Feb. 23, 2022

(65) Prior Publication Data

US 2022/0280997 A1 Sep. 8, 2022

(30) Foreign Application Priority Data

Mar. 3, 2021 (JP) ..... 2021-033605

(51) Int. Cl.

| | |
|---|---|
| ***B22D 11/124*** | (2006.01) |
| ***B22D 11/00*** | (2006.01) |
| ***C22C 1/02*** | (2006.01) |
| ***C22C 9/06*** | (2006.01) |

(52) U.S. Cl.

CPC ..... *B22D 11/004* (2013.01); *B22D 11/1246* (2013.01); *C22C 1/02* (2013.01); *C22C 9/06* (2013.01)

(58) Field of Classification Search

CPC ..... B22D 11/00; B22D 11/004; B22D 11/124; B22D 11/1246; B22D 11/225

USPC ..... 164/486, 444

See application file for complete search history.

(56) References Cited

U.S. PATENT DOCUMENTS

| | | | | |
|---|---|---|---|---|
| 3,713,479 | A * | 1/1973 | Bryson | B22D 11/049 164/487 |
| 4,373,970 | A | 2/1983 | Scorey et al. | |
| 5,198,044 | A | 3/1993 | Colijn et al. | |
| 8,641,837 | B2 | 2/2014 | Aruga et al. | |
| 11,035,024 | B2 | 6/2021 | Weber | |

(Continued)

FOREIGN PATENT DOCUMENTS

| | | | |
|---|---|---|---|
| CN | 102605189 | A | 7/2012 |
| CN | 105665665 | A | 6/2016 |

(Continued)

OTHER PUBLICATIONS

Extended European Search Report (Application No. 22159762.8) dated Sep. 13, 2022.

*Primary Examiner* — Kevin P Kerns

(74) *Attorney, Agent, or Firm* — BURR PATENT LAW, PLLC

(57) ABSTRACT

A method for producing a Cu—Ni—Sn alloy, which achieves both productivity and product quality by reducing internal cracks and dispersing Sn uniformly while shortening the time for cooling an ingot. The method for producing a Cu—Ni—Sn alloy is a continuous casting method or a semi-continuous casting method that includes pouring a molten Cu—Ni—Sn alloy from one end of a mold, both ends of which are open, and continuously drawing out the alloy as an ingot from the other end of the mold while solidifying a part of the alloy, the part being near the mold; performing primary cooling by spraying a liquid mist on the drawn-out ingot; and performing secondary cooling by immersing the ingot having been subjected to the primary cooling in a liquid, thereby making a cast product of the Cu—Ni—Sn alloy.

9 Claims, 3 Drawing Sheets

(56) References Cited

U.S. PATENT DOCUMENTS

| | | | | |
|---|---|---|---|---|
| 11,035,030 | B2 | 6/2021 | Weber | |
| 11,440,086 | B2 * | 9/2022 | Ishii | B22D 11/004 |
| 2021/0332467 | A1 | 10/2021 | Liu et al. | |

FOREIGN PATENT DOCUMENTS

| | | | |
|---|---|---|---|
| CN | 108677059 | A | 10/2018 |
| CN | 111363948 | A | 7/2020 |
| JP | S58-087244 | A | 5/1983 |
| JP | H04-228529 | A | 8/1992 |
| JP | H04-309438 | A | 11/1992 |
| JP | 2004-160543 | A | 6/2004 |
| JP | 2007-169741 | A | 7/2007 |
| JP | 2019-524984 | A | 9/2019 |
| JP | 2019-524985 | A | 9/2019 |

* cited by examiner

* DENOTES COMPARATIVE EXAMPLE

METHOD FOR PRODUCING CU—NI—SN ALLOY

CROSS-REFERENCE TO RELATED APPLICATION

This application claims priority to Japanese Patent Application No. 2021-033605 filed Mar. 3, 2021, the entire contents of which are incorporated herein by reference.

BACKGROUND OF THE INVENTION

1. Field of the Invention

The present invention relates to a method for producing a Cu—Ni—Sn alloy.

2. Description of the Related Art

In the past, a copper alloy, such as a Cu—Ni—Sn alloy, has been produced by a continuous casting method or a semi-continuous casting method. The continuous casting method as well as the semi-continuous casting method is one of the main casting methods and is such that a molten metal is poured into a water-cooled mold to be solidified continuously and drawn out as an ingot having a certain shape (such as a rectangular shape or a round shape), and the ingot is drawn out downward in many cases. This method produces an ingot in a perfectly continuous manner and therefore is excellent in producing a large amount of an ingot having constant components, quality, and shape, but is unsuitable for production of wide variety of ingots. The semi-continuous casting method, on the other hand, is a batch type casting method by which the length of an ingot is limited, and in the semi-continuous casting method, the product class and shape/size can be changed variously. In addition, a large-sized coreless furnace has been used in recent years, so that increasing the size of a cross section of an ingot, lengthening an ingot, and casting a large number of ingots at a time have been enabled, and therefore the semi-continuous casting method can have productivity which is comparable to that of the continuous casting method.

For example, Patent Literature 1 (JP2007-169741A) discloses that when a copper alloy is produced, the copper alloy having a predetermined chemical component composition is smelted in a coreless furnace and then subjected to ingot casting by a semi-continuous casting method to obtain an objective ingot. The obtained ingot is then cooled and is subjected to predetermined steps, such as rolling, and an objective alloy is thereby obtained.

When a microstructure of a Sn-containing ingot is observed after casting the ingot, segregation of Sn is seen in some cases, and in order to suppress variations in the characteristics of a copper alloy and improve the characteristics, Sn is desirably dispersed uniformly. For example, Patent Literature 2 (JP2019-524984A) and Patent Literature 3 (JP2019-524985A) disclose a high-strength boron-containing Cu—Ni—Sn alloy for the purpose of homogenization of Sn and state that segregation containing a large amount of Sn does not occur particularly in the grain boundaries of the alloy. Patent Literature 4 (JPH04-228529A) discloses a method for producing a Cu—Ni—Sn alloy and states that this alloy is substantially homogeneous. Patent Literature 5 (JPS58-87244A) discloses a spinodal alloy strip containing a Sn component and states that the Sn component is dispersed substantially uniformly.

CITATION LIST

Patent Literature

Patent Literature 1: JP2007-169741A
Patent Literature 2: JP2019-524984A
Patent Literature 3: JP2019-524985A
Patent Literature 4: JPH04-228529A
Patent Literature 5: JPS58-87244A

SUMMARY OF THE INVENTION

When an ingot resulting from the solidification of a molten metal in a casting step is cooled, the speed of cooling the ingot gives an influence on the productivity and product quality of an alloy to be obtained finally. For example, when the cooling speed is fast, internal cracks occur in the ingot to deteriorate the product quality of the alloy to be obtained. By contrast, when the cooling speed is slow, the internal cracks in the ingot can be suppressed, but cooling requires a time, and therefore the productivity of the alloy to be obtained becomes poor. Therefore, in the production of an alloy, the productivity and product quality of the alloy are in a trade-off relationship, and achieving both the productivity and the product quality is desired.

Particularly when a copper alloy containing Sn having a low melting point (such as a Cu—Ni—Sn alloy) is made into an ingot, the internal stress in a solidifying process is large at the outside and inside of the ingot. For example, when the ingot is cooled with a water-cooling shower, by immersion into a water tank, or the like, which is a cooling method which has been performed in the past, the internal cracks are liable to occur in the ingot because the cooling speed is too fast. Even when the cooling speed is slowed by, for example, air-cooling in order to suppress the occurrence of the internal cracks, cooling requires 12 hours or longer in some cases, and therefore the productivity is remarkably poor. In addition, as described above, when a microstructure of a Sn-containing ingot is observed after casting the ingot, segregation of Sn is seen in some cases, and in order to suppress variations in the characteristics of a copper alloy and improve the characteristics, Sn is desirably dispersed uniformly. The segregation of Sn is more unlikely to occur when the cooling speed is faster, but as described above, when the cooling speed is fast, the internal cracks are liable to occur in the ingot.

As the Cu—Ni—Sn alloy, Cu-15Ni-8Sn alloy defined as UNS: C72900, Cu-9Ni-6Sn alloy defined as UNS: C72700, and Cu-21Ni-5Sn alloy defined as UNS: C72950, and the like are known. As described above, the internal cracks and the segregation of Sn are liable to occur in a copper alloy containing Sn having a low melting point, and among the copper alloys containing Sn, when the Cu-15Ni-8Sn alloy with a high Sn content is produced, the influence of the cooling condition (for example, cooling speed) of the ingot on the productivity and product quality of the alloy to be obtained is particularly large. As described above, improving the productivity (for example, making the cooling speed faster) and also improving the product quality (for example, suppressing the internal cracks and dispersing Sn uniformly), that is, achieving both the productivity and the product quality by appropriately selecting the cooling condition of the ingot in the production of the Cu—Ni—Sn alloy is desired.

The inventor has now discovered that by adopting mist cooling (primary cooling) in which a liquid mist is sprayed on the ingot and cooling by immersion of the ingot in a liquid (secondary cooling), it is possible to provide a method for producing a Cu—Ni—Sn alloy, which can reduce the internal cracks and disperse Sn uniformly in spite of shortening the time for cooling an ingot, and thereby achieves both the productivity and the product quality.

Accordingly, an object of the present invention is to provide a method for producing a Cu—Ni—Sn alloy, which reduces the internal cracks and enables dispersing Sn uniformly in spite of shortening the time for cooling an ingot, and thereby achieves both the productivity and the product quality.

According to an aspect of the present invention, there is provided a method for producing a Cu—Ni—Sn alloy by a continuous casting method or a semi-continuous casting method, the method comprising:

pouring a molten Cu—Ni—Sn alloy from one end of a mold, both ends of which are open, and continuously drawing out the alloy as an ingot from the other end of the mold while solidifying a part of the alloy, the part being near the mold, performing primary cooling by spraying a liquid mist on the drawn-out ingot, and performing secondary cooling by immersing the ingot having been subjected to the primary cooling in a liquid, thereby making a cast product of the Cu—Ni—Sn alloy.

DETAILED DESCRIPTION OF THE INVENTION

Figure 1:
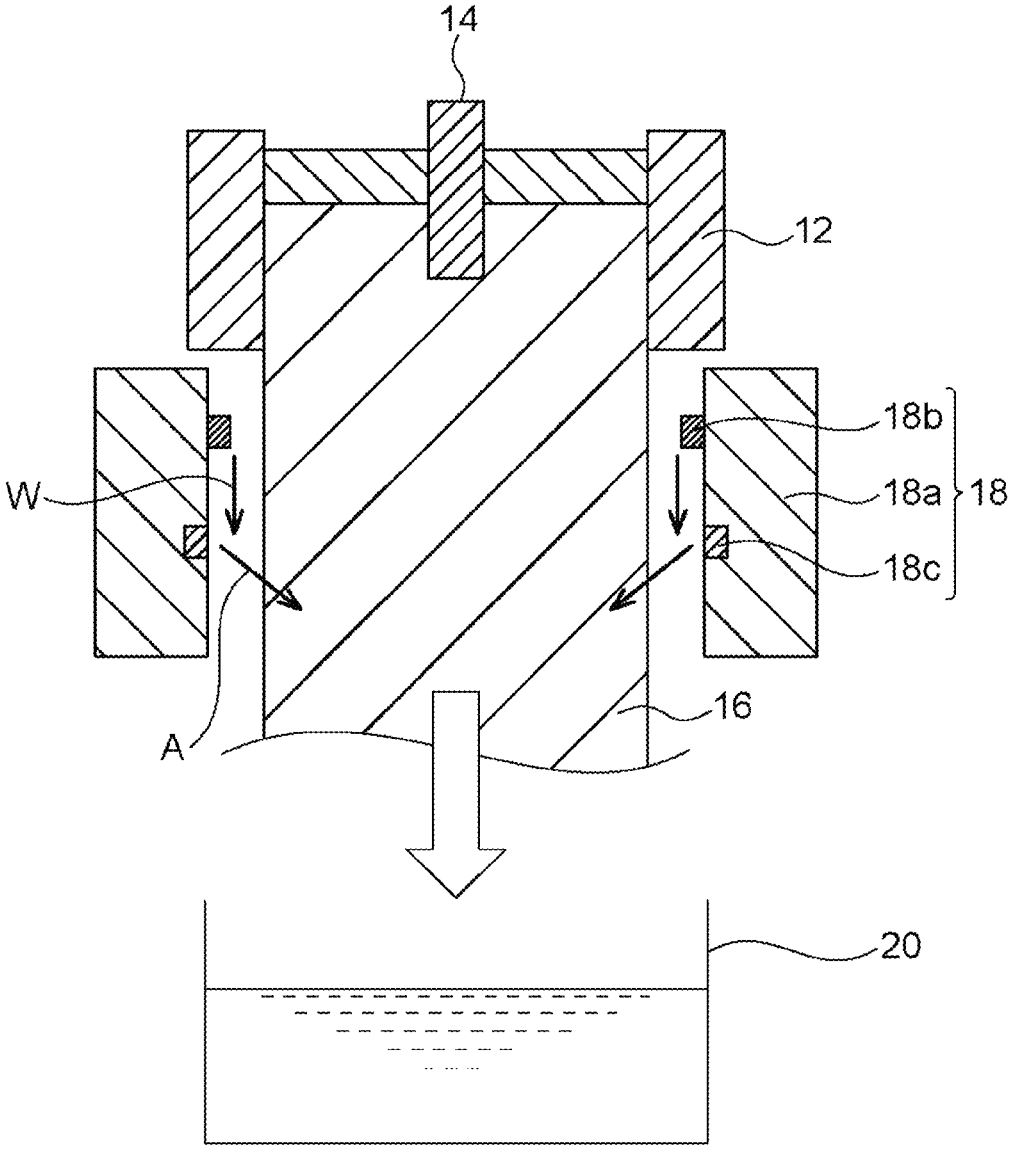
FIG. 1 is a cross-sectional view of production equipment including a mold, a cooler, and a liquid tank, the production equipment to be used for a production method of the present invention.

A production method of the present invention is a method for producing a Cu—Ni—Sn alloy by a continuous casting method or a semi-continuous casting method. The Cu—Ni—Sn alloy which is produced by the method of the present invention is preferably a spinodal alloy containing Cu, Ni, and Sn. This spinodal alloy preferably contains Ni: 8 to 22% by weight and Sn: 4 to 10% by weight, with the balance being Cu and inevitable impurities; the spinodal alloy more preferably contains Ni: 14 to 16% by weight and Sn: 7 to 9% by weight, with the balance being Cu and inevitable impurities; and the spinodal alloy still more preferably contains Ni: 14.5 to 15.5% by weight and Sn: 7.5 to 8.5% by weight, with the balance being Cu and inevitable impurities. Preferred examples of such a Cu—Ni—Sn alloy include Cu-15Ni-8Sn alloy defined as UNS: C72900. When the copper alloy containing Sn having a low melting point as described herein is produced, the internal cracks and the segregation of Sn are liable to occur in a step of cooling an ingot, but according to the method for producing a Cu—Ni—Sn alloy of the present invention, the internal cracks are reduced and Sn is dispersed uniformly in spite of shortening the time for cooling the ingot, so that both the productivity and the product quality can be achieved.

The method for producing a Cu—Ni—Sn alloy of the present invention includes (1) a melt-casting step and (2) a cooling step. In the melt-casting step, a molten Cu—Ni—Sn alloy is poured from one end of a mold whose both ends are open and is continuously drawn out as an ingot from the other end of the mold while a part of the alloy, the part being near the mold, is being solidified. In the cooling step that follows the melt-casting step, primary cooling is performed by spraying a liquid mist on the drawn-out ingot and secondary cooling is performed by immersing the ingot having been subjected to the primary cooling in a liquid to make a cast product of the Cu—Ni—Sn alloy. In this way, when the primary cooling is performed (that is, mist cooling is performed) by spraying the liquid mist on the ingot obtained by melt-casting, and the secondary cooling is subsequently performed by immersing the ingot in the liquid, thereby the internal cracks are reduced and Sn is dispersed uniformly in spite of shortening the time for cooling the ingot, so that a high-quality Cu—Ni—Sn alloy can be produced with high productivity.

As described above, the cooling condition (for example, cooling speed) of the ingot gives an influence on the productivity and product quality of an alloy to be obtained in the production of the copper alloy containing Sn having a low melting point, and therefore achieving both the productivity and the product quality has been difficult. According to the method of the present invention, however, there is an advantage in that it is possible to provide a Cu—Ni—Sn alloy in which the internal cracks are reduced and Sn is dispersed uniformly in spite of shortening the time for cooling the ingot, so that both the productivity and the product quality are achieved.

FIG. 1 shows a cross-sectional view of production equipment and an ingot in one example of the production method of the present invention. Hereinafter, the above-described steps will be described with reference to FIG. 1.

(1) Melt-Casting Step

A molten Cu—Ni—Sn alloy is first poured from one end of a mold 12, both ends of which are open (for example, through a graphite nozzle 14), and is continuously drawn out as an ingot 16 from the other end of the mold 12 while a part of the alloy, the part being near the mold 12, is being solidified. The temperature of the molten Cu—Ni—Sn alloy is preferably 1200 to 1400° C., more preferably 1250 to 1350° C., and still more preferably 1300 to 1350° C.

As the mold 12, a general mold used for casting a copper alloy may be used, and the mold 12 is preferably a mold made of copper though not particularly limited thereto. A cooling medium, such as water, is preferably circulated inside the mold 12. Thereby, a molten, high-temperature Cu—Ni—Sn alloy can be drawn out continuously as the ingot 16 from the other end of the mold 12 while it is being solidified quickly from the surface layer.

In the melt-casting step, suppression of oxidation is preferably performed by an industrially utilizable method. For example, the melt-casting step is preferably performed in an inert atmosphere, such as nitrogen, argon, or vacuum, in order to suppress oxidation of the molten metal.

A pre-treatment, such as a slag treatment or component analysis, for obtaining a desired Cu—Ni—Sn alloy may be performed after melting the Cu—Ni—Sn alloy and before casting the molten Cu—Ni—Sn alloy. For example, casting may be performed after melting the Cu—Ni—Sn alloy preferably at 1300 to 1400° C., making the components uniform through stirring for a certain time, and performing a slag treatment. The stirring time is preferably 15 to 30 minutes. In addition, part of the Cu—Ni—Sn alloy may be taken out as a sample for component analysis to measure the component values after the slag treatment. When the component values are found to be out of objective component values from the result of this measurement, the Cu—Ni—Sn alloy may be added again to adjust the component values in such a way as to obtain the objective component values.

(2) Cooling Step

The primary cooling is performed by spraying the liquid mist on the ingot 16 drawn out from the other end of the mold 12 (that is, mist cooling is performed), and subsequently the secondary cooling is performed by immersing the ingot in the liquid, thereby making the cast product of the Cu—Ni—Sn alloy. By performing the secondary cooling in addition to the primary cooling, the internal cracks are reduced and Sn is dispersed uniformly in spite of shortening the time for cooling the ingot 16, so that the high-quality Cu—Ni—Sn alloy can be produced with high productivity. That is, although examples of the conventional method for cooling the ingot 16 containing Cu, Ni, and Sn include direct spraying of air shower or a liquid shower, and direct immersion in a liquid, it has been difficult by these methods to reduce the internal cracks and disperse Sn uniformly in spite of shortening the time for cooling the ingot 16. However, (i) according to the combination of the mist cooling and the immersion cooling, the internal cracks can be reduced while shortening the time for cooling the ingot 16. (ii) Further, by performing the immersion cooling on the ingot 16 in addition to the mist cooling, not only the time required for cooling the ingot 16 is shortened but also segregation of a microstructure, that is the segregation of Sn, is made more unlikely to occur compared to the case where cooling is performed only by the mist cooling, so that the ingot 16 can be made in such a way as to have a homogeneous composition. (iii) By removing the heat of the ingot 16 just after melt-casting by the mist cooling and then performing the immersion cooling in this way, the internal cracks can be made to be unlikely to occur and the segregation of Sn can be made to be unlikely to occur in the ingot 16 in spite of shortening the time for cooling the ingot 16. When water is directly sprayed on the ingot 16 with a water-cooling shower or the like instead of mist cooling, or immersion cooling is performed without performing mist cooling, the ingot 16 has been broken in the past because the cooling speed (temperature gradient) is too fast in both cases. However, as described above, by performing the primary cooling by the mist cooling and subsequently performing the secondary cooling by the immersion cooling, such a problem can be solved.

As described above, the cooling step includes the steps of performing the primary cooling and performing the secondary cooling, and in these steps, the liquid is not particularly limited as long as it can be used as a cooling medium, such as water and oil, but is preferably water from the viewpoint of easiness of handling and production costs. In addition, oil may be used as a cooling medium from the viewpoint of adjusting the cooling speed.

The ingot 16 having passed through the mold 12 is preferably cooled to 50° C. or lower within 30 minutes after completion of casting, more preferably cooled to 50° C. or lower within 20 minutes after completion of casting, still more preferably cooled to 100° C. or lower within 10 minutes after completion of casting, and particularly preferably cooled to 500° C. or lower within 5 minutes after completion of casting. By cooling the ingot 16 in a short time in this way, the casting cycle by a continuous casting method and a semi-continuous casting can be shortened and the productivity can be improved.

In the cooling step, the primary cooling is preferably performed by allowing the ingot 16 to pass through a cooler 18 arranged immediately below the mold 12. Thereby, the ingot 16 is subjected to mist cooling immediately after the ingot 16 is drawn out from the other end of the mold 12, and can be cooled quickly without cracking not only on the surface layer of the ingot 16 but also inside the ingot 16. In addition, when the ingot 16 is drawn out from the other end of the mold 12 and is allowed to pass through the cooler 18 to be lowered, the ingot 16 may be lowered while the ingot 16 is being supported by a receiving table (not shown). The ingot 16 is preferably supported by a receiving table, and the receiving table is lowered at a speed of 25 to 35 mm/min, more preferably lowered at a speed of 30 to 35 mm/min, and still more preferably lowered at a speed of 33 to 35 mm/min.

The preferred cooler 18 includes a columnar main body 18*a*, a liquid supply part 18*b*, and an air ejection part 18*c*. The liquid supply part 18*b* is provided at the upper part of the columnar main body 18*a* and is configured in such a way as to discharge a liquid W (for example, water) downward, and the air ejection part 18*c* is provided below the liquid supply part 18*b* and is configured in such a way as to eject air A toward the central axis of the columnar main body 18*a*. According to such a configuration, the liquid W discharged from the liquid supply part 18*b* is mixed with air A to a make liquid mist (namely, mist), and this liquid mist can be ejected on the ingot 16 which exists the inside of the columnar main body 18*a*. Thereby, not only shortening of the time for cooling the ingot 16 and suppression of the internal cracks can effectively be achieved but also further shortening of the time for cooling the ingot 16 and homogenization of Sn by the subsequent immersion cooling are made possible, so that both the productivity and the product quality of the Cu—Ni—Sn alloy can be achieved. In addition, dust, such as carbon, is contained in the discharged liquid W, and therefore the diameter of a nozzle (also referred to as a hole) that ejects air A is desirably adjusted in such a way that the nozzle does not clog up. The diameter of the nozzle is preferably a diameter of 2 to 5 mm, and more preferably a diameter of 3 to 4 mm. The rate of flow of the liquid W which is discharged from the liquid supply part 18*b* is preferably 7 to 13 L/min, and more preferably 9 to 11 L/min. The pressure of air A which is ejected from the air ejection part 18*c* is preferably 2.0 to 4.0 MPa, and more preferably 2.7 to 3.3 MPa.

The cooler 18 is preferably configured in such a way that the liquid W which is discharged downward mixes with air A without directly hitting against the ingot 16. Thereby, the discharged liquid W does not directly hit against the ingot 16 and the ingot 16 is not quenched locally, and therefore mist cooling can be performed uniformly over the whole ingot 16, so that occurrence of the internal cracks can be more suppressed. In the subsequent immersion cooling, the segregation of Sn can be more suppressed by cooling the ingot 16 uniformly and quickly while suppressing the internal cracks of the ingot 16. In addition, the cooler 18 is preferably configured in such a way that the position of the liquid W which is discharged from the liquid supply part 18*b* is nearer to the columnar main body 18*a* than the position of the air ejection part 18*c*. Thereby, air A from the air ejection part 18*c* is sprayed well on the place where the liquid W is discharged from the liquid supply part 18*b*, so that the liquid mist (namely, mist) can be generated efficiently.

In addition, the air ejection part 18*c* of the cooler 18 is preferably configured in such a way as to eject air A diagonally downward. When the force of the liquid W from the liquid supply part 18*b* is weak, the liquid W is discharged downward by gravity and the position where the liquid W hits against the ingot as a liquid mist is lowered, so that unevenness in the cooling speed occurs. However, when the air ejection part 18*c* is configured in such a way as to eject air A diagonally downward, a difference in the position where the liquid W hits against the ingot thereby does not occur depending on the force of the liquid W (flow rate), so that cooling speed can be made uniform.

The secondary cooling is preferably performed by immersing the ingot 16 sequentially and continuously from a lower end part of the ingot 16 into a liquid tank 20. In addition, this liquid tank 20 is preferably provided immediately below the cooler 18. By performing the primary cooling prior to the secondary cooling and thereby removing the heat of the ingot 16 just after melt-casting, the internal cracks can be made to be more unlikely to occur even if the ingot 16 is immersed in the liquid continuously after the primary cooling. Therefore, the internal cracks in the ingot 16 can effectively be suppressed while an advantageous point due to quenching, which refers to suppression of the segregation of Sn, is utilized.

The ingot 16 is immersed in the liquid in the secondary cooling, and the liquid tank 20 into which the ingot 16 is immersed may be a liquid tank provided in a pit shape in the ground or may be a liquid tank arranged on the ground. In addition, by performing treatment, such as circulating the liquid, or adding a new liquid continuously at all times, in the liquid tank 20, the increase in the liquid temperature may by suppressed when the ingot 16 is immersed in the liquid.

EXAMPLES

The present invention will be described more specifically with reference to the following examples.

Example 1

Cu-15Ni-8Sn alloy defined as UNS: C72900 was prepared as a Cu—Ni—Sn alloy and evaluated by the following procedures.

(1) Weighing

A pure Cu nugget, a Nickel metal, a Sn metal, manganese tourmaline, and a Cu—Ni—Sn alloy scrap, which are raw materials for a Cu—Ni—Sn alloy, were weighed in such a way as to obtain an objective composition. That is, Cu in an amount of 163 kg, Ni in an amount of 30 kg, Sn in an amount of 15 kg, and the Cu—Ni—Sn alloy scrap in an amount of 1450 kg were weighed and mixed to be thereby formulated.

(2) Melting and Slag Treatment

The weighed raw materials for a Cu—Ni—Sn alloy were melted in a high-frequency melting furnace for atmospheric air at 1300 to 1400° C. and stirred for 30 minutes to homogenize the components. Slag scraping and slag scooping were performed after completion of melting.

(3) Component Analysis (Before Casting)

Part of the Cu—Ni—Sn alloy obtained by performing the melting and the slag treatment was taken out as a sample for component analysis, and the component values were measured. As a result, it was found that the sample for component analysis contained Ni: 14.9% by weight and Sn: 8.0% by weight, with the balance being Cu and inevitable impurities. This composition satisfies the condition for Cu-15Ni-8Sn alloy defined as UNS: C72900.

(4) Semi-Continuous Casting

The molten metal of the Cu—Ni—Sn alloy which was obtained by performing the melting and the slag treatment was tapped at 1250 to 1350° C. and poured into one end of the mold 12, both ends of which are open, through the graphite nozzle 14, as schematically shown in FIG. 1. On that occasion, the poured molten metal was solidified to make the ingot 16 by the time when the molten metal passed through from the one other end to the other end of the mold 12 by circulating water inside the mold 12. On that occasion, the surface layer of the ingot 16 is mainly solidified.

(5) Primary Cooling and Secondary Cooling (Mist Cooling and Immersion Cooling)

The solidified ingot 16 was continuously drawn out while water mist was being sprayed with the cooler 18 provided immediately below the mold 12. On that occasion, by discharging 7 to 13 L/min of water W from the water supply part 18*b* which is at the upper part of the columnar main body 18*a* of the cooler 18, and blowing air A at a pressure of 0.3 MPa from 120 holes each having a diameter of 3.5 mm, the holes each provided as the air ejection part 18*c* at the lower stage of the columnar main body 18*a* of the cooler 18, discharged water W was atomized into water mist (namely, mist) and was sprayed on the ingot 16 (primary cooling). The flow rate of blown air A is considered to be corresponding to 7500 L/min. In addition, the ingot 16 was lowered while being received by a receiving table (not shown) which was lowered at a speed of 25 to 35 mm/min. Further, the lowered ingot was immersed continuously from the lower end part thereof in the water tank 20 to cool the ingot in water (secondary cooling). By such a cooling method, the ingot 16 was cooled to 50° C. or lower within 30 minutes after the semi-continuous casting of (4) described above.

(6) Taking Out Cast Product

The ingot 16 obtained by water cooling was taken out after the temperature of the ingot 16 became lower than 50° C. to obtain a Cu—Ni—Sn alloy which is a cast product. The size of the cast product was 320 mm in diameter×2 m in length.

(7) Evaluations

The following evaluations were performed for the obtained cast product.

<Check of Internal Cracks>

A disk-like sample of 320 mm in diameter×10 mm in thickness was cut out from the position of 250 mm from the top surface in the longitudinal direction of the cast product and from the position of 150 mm from the bottom surface in the longitudinal direction of the cast product in order to check the internal cracks of the cast product, and visual observation and a red check were performed on both surfaces of the sample.

<Check of Segregation of Sn>

Figure 3A:
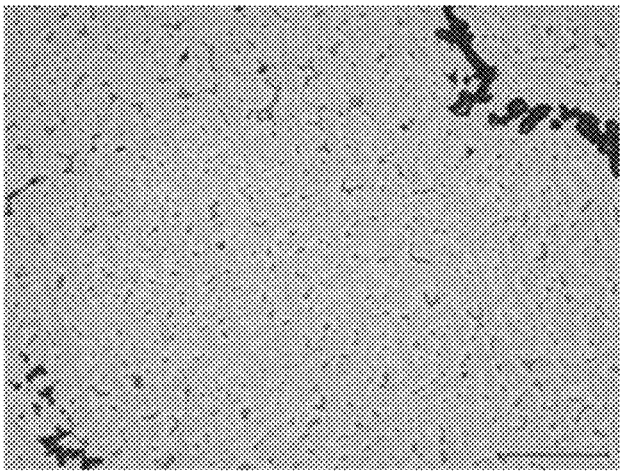
FIG. 3A is an optical microscope image of a sample cut surface cut out from a cast product obtained in Example 1.
Figure 3B:
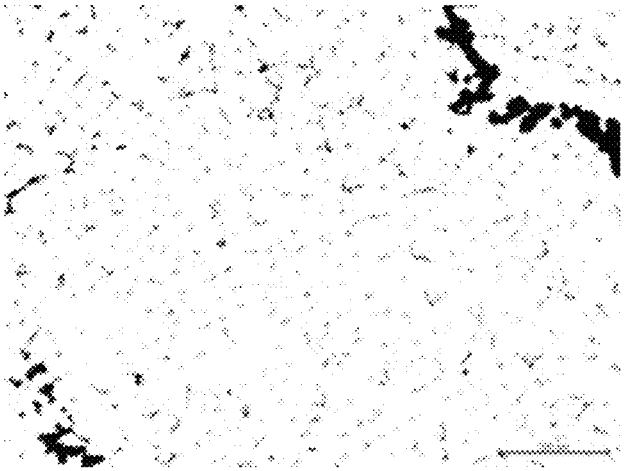
FIG. 3B is an image obtained by binarizing an optical microscope image of a sample cut surface cut out from a cast product obtained in Example 1.

The sample was observed in a visual field of 2.8 mm×2.1 mm at a magnification of 50 times with an optical microscope. The obtained optical microscope image was binarized using image analysis software ImageJ, and the area ratio (%) of Sn (degree of segregation of Sn) was calculated from the resultant binarized image by measuring the area ratio of the area of Sn to the area of the above whole visual field and multiplying the area ratio by 100. The area ratio of Sn was 4.40%. One example of the optical microscope image of the sample of Example 1 and one example of the binarized image of the sample are shown in FIG. 3A and FIG. 3B, respectively.

Example 2 (Comparison)

Preparation and evaluations of a sample were performed in the same manner as in Example 1, except that only the immersion cooling was performed in the following manner in place of the mist cooling and the immersion cooling of (5)

described above. The obtained cast product had a size of 320 mm in diameter×2 m in length.

(Immersion Cooling)

The ingot 16 whose surface layer had been solidified was directly immersed in the water tank 20 and cooled in water without spraying water W and without blowing air A with the cooler 18 provided immediately below the mold 12. In addition, the ingot 16 was lowered while being received by a receiving table (not shown) which was lowered at a speed of 25 to 35 mm/min. By such a cooling method, the ingot 16 was cooled to 50° C. or lower within 20 minutes after the semi-continuous casting of (4) described above.

Example 3 (Comparison)

Preparation and evaluations of a sample were performed in the same manner as in Example 1, except that the water cooling with a cooler was performed in the following manner in place of the mist cooling and the immersion cooling of (5) described above. The obtained cast product had a size of 320 mm in diameter×2 m in length.

(Water Cooling with Cooler)

Liquid water was sprayed, with the cooler 18 provided immediately below the mold 12, on the ingot 16 whose surface layer had been solidified. It is to be noted that on that occasion, air A was not blown from the air ejection part 18*c*, and the ingot 16 was not immersed in the water tank 20. By such a cooling method, the ingot 16 was cooled to 50° C. or lower within 30 minutes after the semi-continuous casting of (4) described above.

Example 4 (Comparison)

Figure 4A:
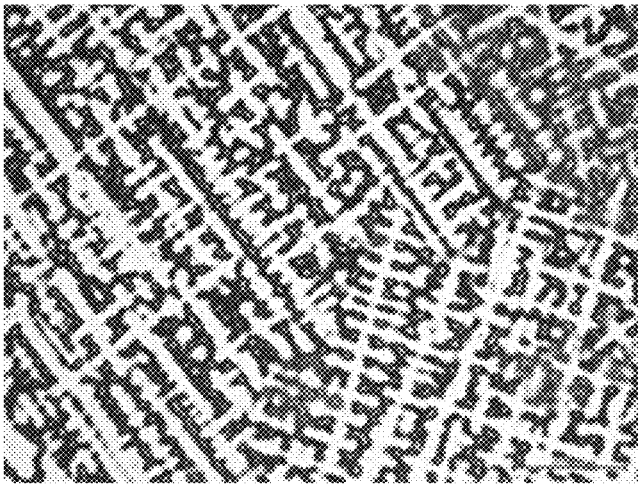
FIG. 4A is an optical microscope image of a sample cut surface cut out from a cast product obtained in Example 4.
Figure 4B:
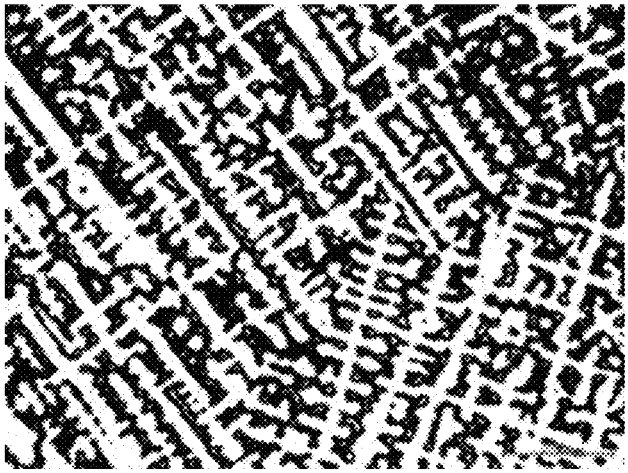
FIG. 4B is an image obtained by binarizing an optical microscope image of a sample cut surface cut out from a cast product obtained in Example 4.

Preparation and evaluations of a sample were performed in the same manner as in Example 1, except that only the mist cooling was performed in the following manner in place of the mist cooling and the immersion cooling of (5) described above. The obtained cast product had a size of 320 mm in diameter×2 m in length. In addition, the area ratio of Sn calculated by the optical microscope observation in check of segregation of Sn of (7) described above was 48.29% for the sample of Example 4. One example of the optical microscope image of this sample and one example of the binarized image of the sample are shown in FIG. 4A and FIG. 4B, respectively.

(Mist Cooling)

The solidified ingot 16 was continuously drawn out while water mist was being sprayed with the cooler 18 provided immediately below the mold 12, as schematically shown in FIG. 1. On that occasion, by discharging 7 to 13 L/min of water W from the water supply part 18*b* which is at the upper part of the columnar main body 18*a* of the cooler 18, and blowing air A at a pressure of 2.7 to 3.3 MPa from 120 holes each having a diameter of 3.5 mm, the holes each provided as the air ejection part 18*c* at the lower stage of the columnar main body 18*a* of the cooler 18, discharged water W was atomized into water mist (namely, mist) and was sprayed on the ingot 16. In addition, the ingot 16 was lowered while being received by a receiving table (not shown) which was lowered at a speed of 25 mm/min. On that occasion, the ingot 16 was not immersed in the water tank 20. By such a cooling method, the ingot 16 was cooled to 50° C. or lower within 2 hours after the semi-continuous casting of (4) described above.

Example 5 (Comparison)

Preparation and evaluations of a sample were performed in the same manner as in Example 1, except that the air cooling was performed in the following manner in place of the mist cooling and the immersion cooling of (5) described above. The obtained cast product had a size of 320 mm in diameter×2 m in length.

(Air Cooling)

The solidified ingot 16 was continuously drawn out while air A was being blown with the air ejection part 18*c* of the cooler 18 provided immediately below the mold 12. On that occasion, air was blown from 120 holes each having a diameter of 3.5 mm, the holes provided at the columnar main body of the cooler, and the ingot was lowered while being received with a receiving table which was lowered at a speed of 25 mm/min. That is, the ingot 16 was cooled only by air A from the cooler 18 without spraying water W from the cooler 18 or immersing the ingot 16 in the water tank 20. By such a cooling method, the ingot was cooled to 50° C. in 12 hours after the semi-continuous casting of (4) described above. In the case of air cooling, it can be said that the speed of cooling the ingot is slow, and therefore, the internal cracks are unlikely to occur, but the productivity is poor because cooling requires a long time.

Example 6 (Comparison)

Preparation and evaluations of a sample were performed in the same manner as in Example 1, except that the ingot 16 was left to stand for 24 hours after the semi-continuous casting of (4) described above until the ingot 16 was cooled to 50° C. without performing cooling using the cooler 18 and the water tank 20 on the ingot 16 having passed through the mold 12. The obtained cast product had a size of 320 mm in diameter×2 m in length.

Results

Figure 2:
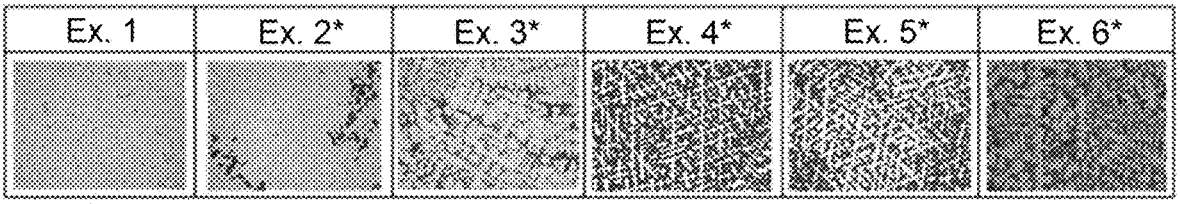
FIG. 2 is a table showing optical microscope images in which segregation of Sn was checked for cast products of Cu—Ni—Sn alloys obtained in Examples 1 to 6.

The evaluation results for the cast products obtained in Examples 1 to 6 are summarized in Table 1 and FIG. 2 to which Table 1 refers. The "productivity" in Table 1 shows the time required for producing a cast product one time, and for example, in Example 1 where the cooling method consists of the mist cooling and the immersion cooling, 4 hours are required for producing the cast product one time. As shown in Table 1, in Example 1, a cast product was made in which the internal cracks are not found and Sn is dispersed uniformly in spite of quickly cooling the ingot. That is, a Cu—Ni—Sn alloy such that both the productivity and the product quality are achieved was able to be obtained. It is to be noted that in Example 2, the cooling speed after the casting is short, as short as 20 minutes, but this is almost the same as the cooling speed in Example 1 (30 minutes), and it can be said that the difference of about 10 minutes hardly gives an influence on the productivity. When the cooling speed after the casting is fast, as in Example 2 and Example 3, the productivity of the cast product is high, but the product quality is deteriorated because the internal cracks occur, or for other reasons. On the other hand, when the cooling speed after the casting is slow, as in Example 5 and Example 6, the internal cracks do not occur, but the productivity of the cast product is lowered, and the segregation of Sn is liable to occur. In Example 4 where the cooling method includes only the mist cooling, a cast product can be obtained such that the productivity is relatively high and the internal cracks are suppressed, but the segregation of Sn is seen. In contrast, with respect to the cast product of Example 1 where the cooling method consists of the mist cooling and the immersion cooling, the cooling speed after the casting is fast, and therefore the productivity is high, and the internal cracks and the segregation of Sn are suppressed, making the product quality of the cast product of Example 1 high, as described above.

[Table 1]

TABLE 1

| | Example 1 | Example 2* | Example 3* | Example 4* | Example 5* | Example 6* |
|---|---|---|---|---|---|---|
| Primary cooling | Mist cooling | Not performed | Water cooling | Mist cooling | Air cooling | Not performed |
| Secondary cooling (immersion cooling) | Performed | Performed | Not performed | Not performed | Not performed | Not performed |
| Cooling speed after casting | 50° C. or lower within 30 minutes | 50° C. or lower within 20 minutes | 50° C or lower within 30 minutes | 50° C. or lower within 2 hours | 50° C. or lower within 12 hours | 50° C. or lower within 24 hours |
| Productivity | | 4 h/batch | | 6 h/batch | 12 h/batch | 24 h/batch |
| Internal cracks | Not found | Found | Found | Not found | Not found | Not found |
| Check of segregation of Sn (optical microscope image) | Refer to FIG. 2 | | | | | |

*denotes Comparative Example.

What is claimed is:

1. A method for producing a Cu—Ni—Sn alloy by a continuous casting method or a semi-continuous casting method, the method comprising:

pouring a molten Cu—Ni—Sn alloy from one end of a mold, both ends of which are open, and continuously drawing out the alloy as an ingot from the other end of the mold while solidifying a part of the alloy, the part being near the mold, performing primary cooling by spraying a liquid mist on the ingot, and performing secondary cooling by immersing the ingot having been subjected to the primary cooling in a liquid, thereby making a cast product of the Cu—Ni—Sn alloy;

wherein the Cu—Ni—Sn alloy is a spinodal alloy comprising Ni: 8 to 22% by weight and Sn: 4 to 10% by weight, with the balance being Cu and inevitable impurities.

2. The method for producing a Cu—Ni—Sn alloy according to claim 1, wherein the Cu—Ni—Sn alloy is a spinodal alloy comprising Ni: 14 to 16% by weight and Sn: 7 to 9% by weight, with the balance being Cu and inevitable impurities.

3. The method for producing a Cu—Ni—Sn alloy according to claim 1, wherein the ingot having passed through the mold is cooled to 50° C. or lower within 30 minutes after completion of the casting.

4. The method for producing a Cu—Ni—Sn alloy according to claim 1, wherein the primary cooling is performed by allowing the ingot to pass through a cooler disposed immediately below the mold.

5. The method for producing a Cu—Ni—Sn alloy according to claim 4, wherein the cooler comprises:

a columnar main body;

a liquid supply part provided at an upper part of the columnar main body and configured in such a way as to discharge the liquid downward; and an air ejection part that ejects air toward a central axis of the columnar main body, the air ejection part provided below the liquid supply part.

6. The method for producing a Cu—Ni—Sn alloy according to claim 5, wherein the cooler is configured in such a way that the liquid that is discharged downward is mixed with the air without directly hitting against the ingot.

7. The method for producing a Cu—Ni—Sn alloy according to claim 1, wherein the secondary cooling is performed by immersing the ingot sequentially and continuously from a lower end part of the ingot into a liquid tank.

8. The method for producing a Cu—Ni—Sn alloy according to claim 1, wherein the ingot is supported by a receiving table, and the receiving table is lowered at a speed of 25 to 35 mm/min.

9. The method for producing a Cu—Ni—Sn alloy according to claim 1, wherein the liquid is water.

* * * * *